US005886278A

United States Patent [19]

Yoshida

[11] Patent Number: 5,886,278

[45] Date of Patent: Mar. 23, 1999

[54] APPARATUS FOR REDUCING CHANGE IN TIMBRE AT EACH POINT WHERE TONE RANGES ARE SWITCHED

[75] Inventor: Toshiya Yoshida, Hamamatsu, Japan

[73] Assignee: Kawai Musical Instruments Manufacturing Co., Ltd., Hamamatsu, Japan

[21] Appl. No.: 963,952

[22] Filed: Nov. 4, 1997

[30] Foreign Application Priority Data

Nov. 5, 1996 [JP] Japan ..... 8-307486

[51] Int. Cl.[6] ..... G10H 7/02

[52] U.S. Cl. ..... 84/604; 84/621; 84/DIG. 9

[58] Field of Search ..... 84/603–607, 613, 84/622–625, 637, 621, DIG. 9

[56] References Cited

U.S. PATENT DOCUMENTS 4,942,799 7/1990 Suzuki ..... 84/603

5,050,474 9/1991 Ogawa et al. ..... 84/603

5,262,582 11/1993 Hanzawa et al. ..... 84/604 X 5,597,970 1/1997 Sato et al. ..... 84/604

*Primary Examiner*—Stanley J. Witkowski

*Attorney, Agent, or Firm*—Christie, Parker & Hale, LLP

[57] ABSTRACT

A tone waveform reproduction apparatus, for an electronic musical instrument employing a plurality of samples in consonance with tone ranges, that can reduce a change in a timbre so that it will not be noticeable, and that can provide a natural transition of musical tones. An address generator generates a read address for a waveform memory. In the waveform memory are stored waveform data that differ for each timbre and each specific pitch range. A digital filter has a low-pass property and is controlled by a cutoff controller to adjust a timber or a tone quality. The cutoff controller generates a cutoff control signal for compensating for a discontinuity, at a point where tone ranges are switched, of reproduced frequencies of tone signals extracted from the waveform memory, and outputs the cutoff control signal fcn.

6 Claims, 4 Drawing Sheets

APPARATUS FOR REDUCING CHANGE IN TIMBRE AT EACH POINT WHERE TONE RANGES ARE SWITCHED

BACKGROUND OF THE INVENTION

1. Field of the Invention

The present invention relates to a tone waveform reproduction apparatus, and in particular to a tone waveform reproduction apparatus that is employed for electronic musical instruments.

2. Description of the Related Arts

In an electronic musical instrument for storing a tone waveform in a memory and reading it for reproduction, when a pitch is changed for reproduction of a tone waveform, a frequency band included in the original waveform that is reproduced is shifted. Therefore, when the pitch is raised, a reproduced tone waveform is shifted to a frequency higher than the original frequency band, so that the sound of the resultant tone sounds high. On the other hand, when the pitch is decreased, the reproduced tone waveform is shifted to a frequency lower than the original frequency band, so that the sound of the resultant tone sounds low.

Conventionally, to resolve this problem, a method is employed for varying a cutoff frequency of a filter in consonance with keys on a keyboard, i.e., a key scaling method. With this key scaling method, the above problem can be considerably resolved when a single basic tone waveform is used for all the keys on a keyboard.

However, when a plurality of basic tone waveforms, i.e., a plurality of samples, are used in consonance with tone ranges, a reproduced frequency for a tone waveform corresponding to each key is as is indicated by a solid line a in FIG. 5. And if the key scaling b is applied for the reproduced frequency, the frequency is as is indicated by broken line c. It should be noted that the reproduced frequencies a and c are properties obtained after conventional cutoff control was executed at cutoff frequency fco.

As is apparent from the reproduced frequency a, at a point where samples are switched, i.e., where tone ranges are switched, a sample in the low range sounds high while a sample in the high range sounds low. Furthermore, as is apparent from the reproduced frequency c, even when key scaling is applied for the reproduced frequency a, the reproduced frequency is discontinuous at a point where the samples are switched, so that a timbre is rendered unnatural. As is evident from the above description, a conventional cutoff control cannot resolve the problem arising from a timbre being rendered unnatural at a point where samples are switched.

SUMMARY OF THE INVENTION

To remove the above shortcomings, it is one object of the present invention to provide a tone waveform reproduction apparatus that, when a plurality of samples are employed in consonance with tone ranges, can reduce a change in a timbre so that it is not noticeable, and can provide a natural continuation of timbres.

To achieve the above object, according to the present invention, provided is a tone waveform reproduction apparatus, which is employed for an electronic musical instrument using a plurality of sample waveforms in consonance with tone ranges, the tone waveform reproduction apparatus comprising:

waveform storage means for storing a plurality of basic tone waveform data sets consonant with the tone ranges;

cutoff control means for generating a cutoff control signal for compensating for a discontinuity, at a point where the tone ranges are switched, of a reproduced frequency of a tone signal that is reproduced from the tone waveform storage means; and filter means, controlled by the cutoff control means, for controlling a frequency of the tone signal read from the waveform storage means.

According to the present invention, since the reproduced frequency of the tone signal read from the waveform storage means is continuous at the point where the tone ranges are switched, a change in timbres at the point where the samples are switched is not noticeable.

DETAILED DESCRIPTION OF THE PREFERRED EMBODIMENT

Figure 1:
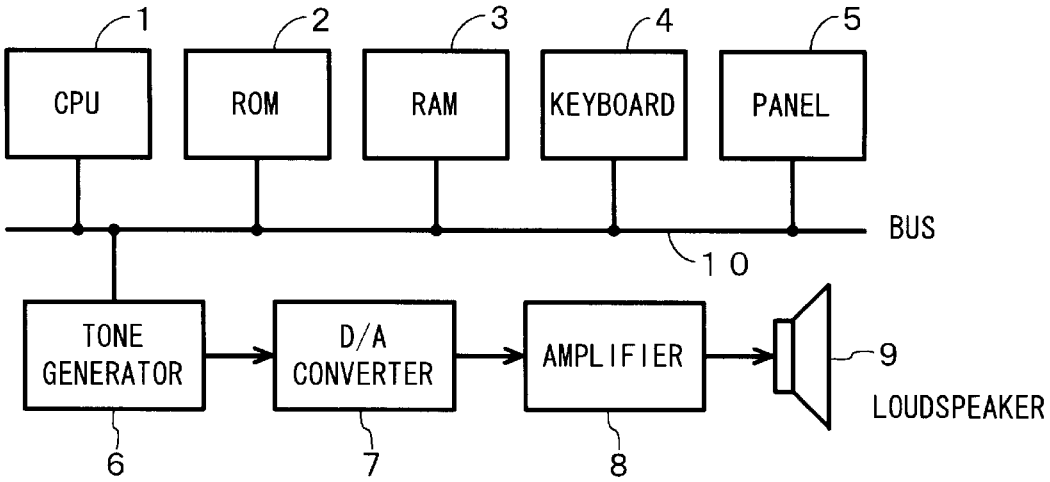
FIG. 1 is a schematic block diagram illustrating one example of hardware arrangement of an electronic musical instrument according to the present invention.

The preferred embodiment of the present invention will now be described in detail while referring to the accompanying drawings. FIG. 1 is a schematic block diagram illustrating the arrangement of an electronic musical instrument according to the present invention.

In FIG. 1, for the entire electronic musical instrument, a CPU 1 performs such processes as a well known key assignment process and a tone generation process by using a program stored in a ROM 2. In the ROM 2 are stored, in addition to a control program, various tables, musical data for automatic playing, and various types of timbre data. A RAM 3 is used as a work area for the CPU 1, and various types of control data, such as a key assignment table and a tone generation control data table, are stored in the RAM 3 and may be backed up by a battery.

A keyboard 4 consists of a plurality of keys, each of which has two switches, and these switches for individual keys are scanned by a keyboard interface (not shown) that is controlled by the CPU 1. On a panel 5 are included various switches, such as a select switch for timbres and rhythm patterns and a number key switch for numerical input; a display device, such as an LED; and a panel interface circuit. Under the control of the CPU 1, a tone generator 6 generates independent digital tone signals for, for example, 16 channels in a time shared manner. A D/A converter 7 converts a digital signal output by the tone generator 6 into an analog signal. An amplifier 8 amplifiers the received analog signal by a predetermined gain. The analog signal is changed to a musical tone at a loudspeaker 9. The individual circuits in the electronic musical instrument are connected by a bus 10. A MIDI circuit may be connected to the bus 10.

Figure 2:
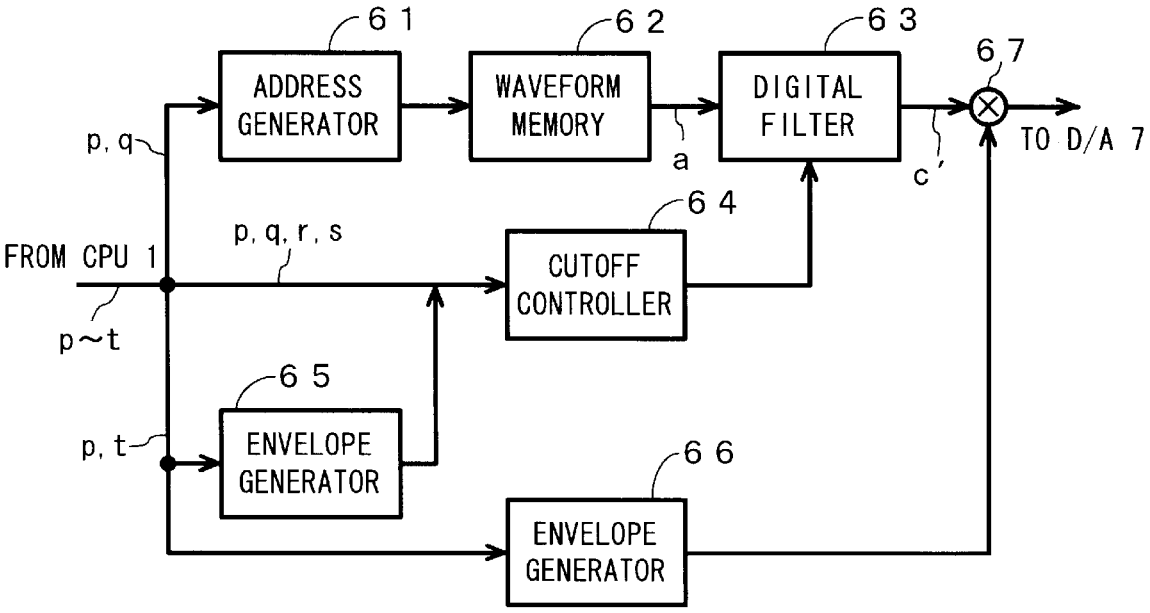
FIG. 2 is a block diagram illustrating a tone generator according to one embodiment of the present invention.

The arrangement and operation of the tone generator 6, which is the essential portion of the present invention, will now be explained while referring to FIG. 2. As is shown in FIG. 2, the tone generator 6 comprises an address generator 61, a waveform memory 62, a digital filter 63, a cutoff controller 64, first and second envelope generators 65 and 66, and a multiplier 67.

The address generator 61 has accumulators, in a number equivalent to the channel count, for accumulating address interval information that is set by the CPU 1 and that corresponds to a reproduced pitch for a depressed key. The address generator 61 generates a read address for the waveform memory 62 for each sampling period, for example. When waveform data is for a repeated waveform, an address is adjusted so that waveform data are repeatedly read in the last predetermined range. The waveform memory 62 is a ROM or RAM in which are stored waveform data that differ for each timbre and for each specific pitch range. The digital filter 63 has a low-pass property, and adjusts the timbre or tone quality under the control of the cutoff controller 64.

The cutoff controller 64 is the essential circuit for the present invention, and the CPU 1 permits the cutoff controller 64 to acquire a cutoff frequency that is consonant with a pitch reproduced for each waveform data set, and to output a filter control signal corresponding to the cutoff frequency. Under the control by the CPU 1, the first and the second envelope generators 65 and 66 generate tone envelope signals corresponding to timbre and touch information. The multiplier 67 multiplies an envelope signal, which is output by the second envelope generator 66, by a signal output by the digital filter 63, and thereby outputs a tone signal.

Now, the operation of the tone generator 6 will be described. The CPU 1 transmits, to the tone generator 6, key data p indicating which key has been depressed; frequency q for a basic tone waveform corresponding to the tone range of the depressed key; a cutoff frequency r; a parameter (Cn)s used for adjusting the performance of cutoff control; and parameter t for determining an envelope. While the cutoff frequency is set by a user employing a means (not shown) for that purpose, the cutoff frequency r is the one obtained by changing the cutoff frequency in consonance with the key pitch with an operation of the CPU 1.

The address generator 61 receives the key data p and the frequency q of the basic tone waveform from the CPU 1. Thereafter, the address generator 61 generates a read address for the waveform memory 62 based on these data. The cutoff controller 64 receives the key data p, the frequency q of the basic tone waveform, the cutoff frequency r and the parameter (Cn)s from the CPU 1. The cutoff controller 64 employs these data sets to acquire a cutoff frequency fcn, which will be described later, and generates a corresponding filter control signal and outputs it to the digital filter 63. The first and the second envelope generators 65 and 66 receive the key data p and the parameter t for determining an envelope. The first and the second envelope generators 65 and 66 generate envelope signals based on the received data, and output them respectively to the cutoff controller 64 and the multiplier 67.

At this time, the operation of the cutoff controller 64 will be explained. The cutoff controller 64 employs the key data p and the frequency q of the basic tone waveform to acquire a pitch (original pitch Po) of the basic tone waveform data. In addition, the cutoff controller 64 acquires a cutoff frequency fco in the conventional manner by adding the cutoff frequency r to the output from the first envelope generator 65. Therefore, the cutoff frequency fco is the one that is set by the conventional method.

Sequentially, the cutoff controller 64 employs the cutoff frequency fco, which is set by the conventional method, the parameter Cn for adjusting the performance of the cutoff controller, the original pitch Po, and a pitch Pp corresponding to the pitch of a depressed key to determine a cutoff frequency fcn that is represented by the follow equation. The cutoff controller 64 also outputs, to the digital filter 63, a filter control signal (cutoff control signal) corresponding to the cutoff frequency fcn.

$$fcn=fco\times Cn\times Po/Pp.$$

Figure 3A:
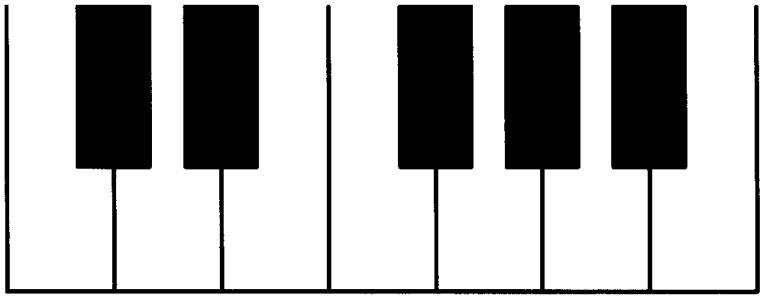
FIGS. 3A through 3E are diagrams for explaining the processing for the embodiment of the present invention.
Figure 3B:
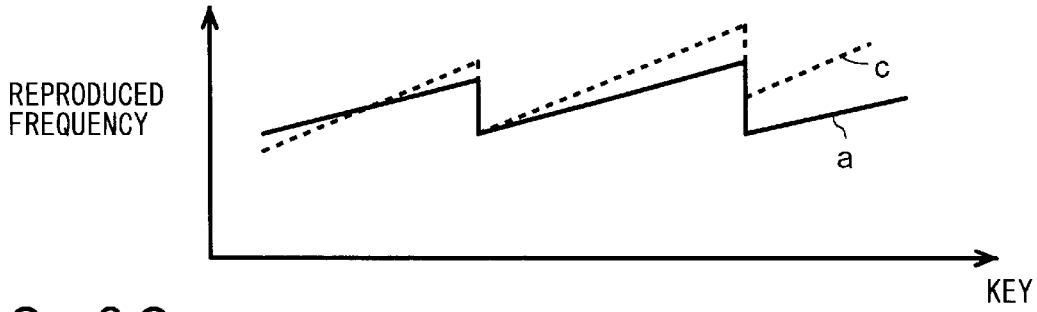
Figure 3C:
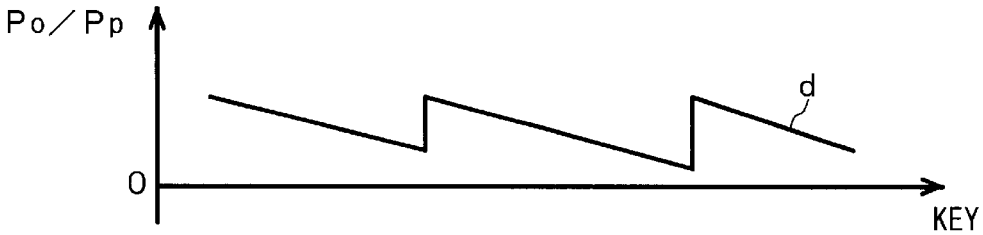
Figure 3D:
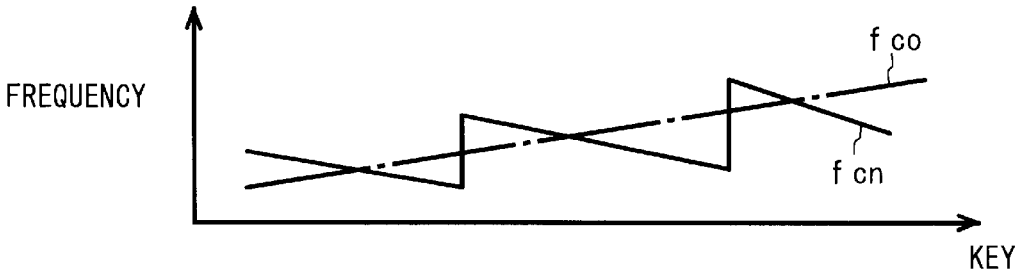
Figure 3E:
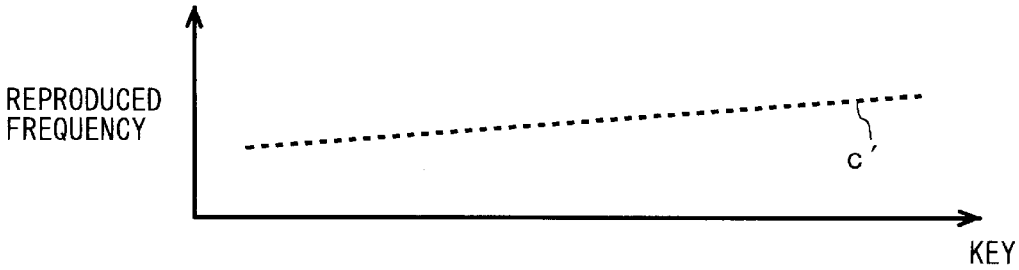

While referring to FIGS. 2 and 3A to 3E, an explanation will be given for an operation for controlling the digital filter 63 by employing the filter control signal corresponding to the cutoff frequency fcn that is acquired by using the above equation. The frequency property of a tone signal output by the waveform memory 62 is as indicated by the solid line a in FIG. 3B. Since the reproduced pitch Pp becomes greater than Po as the position of a key is shifted to the right, Po/Pp in the above equation is as is indicated by a solid line d in FIG. 3C. Since, as is shown in the chained line in FIG. 3D, a property of the cutoff frequency fco is that it simply increases, the cutoff frequency fcn acquired by the cutoff controller 64 is as is shown in FIG. 3D. When the digital filter 63 is controlled by using a filter control signal corresponding to the cutoff frequency fcn, the frequency property of a signal output by the digital filter 63 is indicated by a broken line c' in FIG. 3E. As a result, there is no change in timbre at the point where the samples are switched, and a natural continuity can be provided for the timbre. When the parameter Cn is changed, for example, a width of the change at the point where the tone range for Po/Pp is switched in FIG. 3C can be altered.

Figures 4A, 4B:
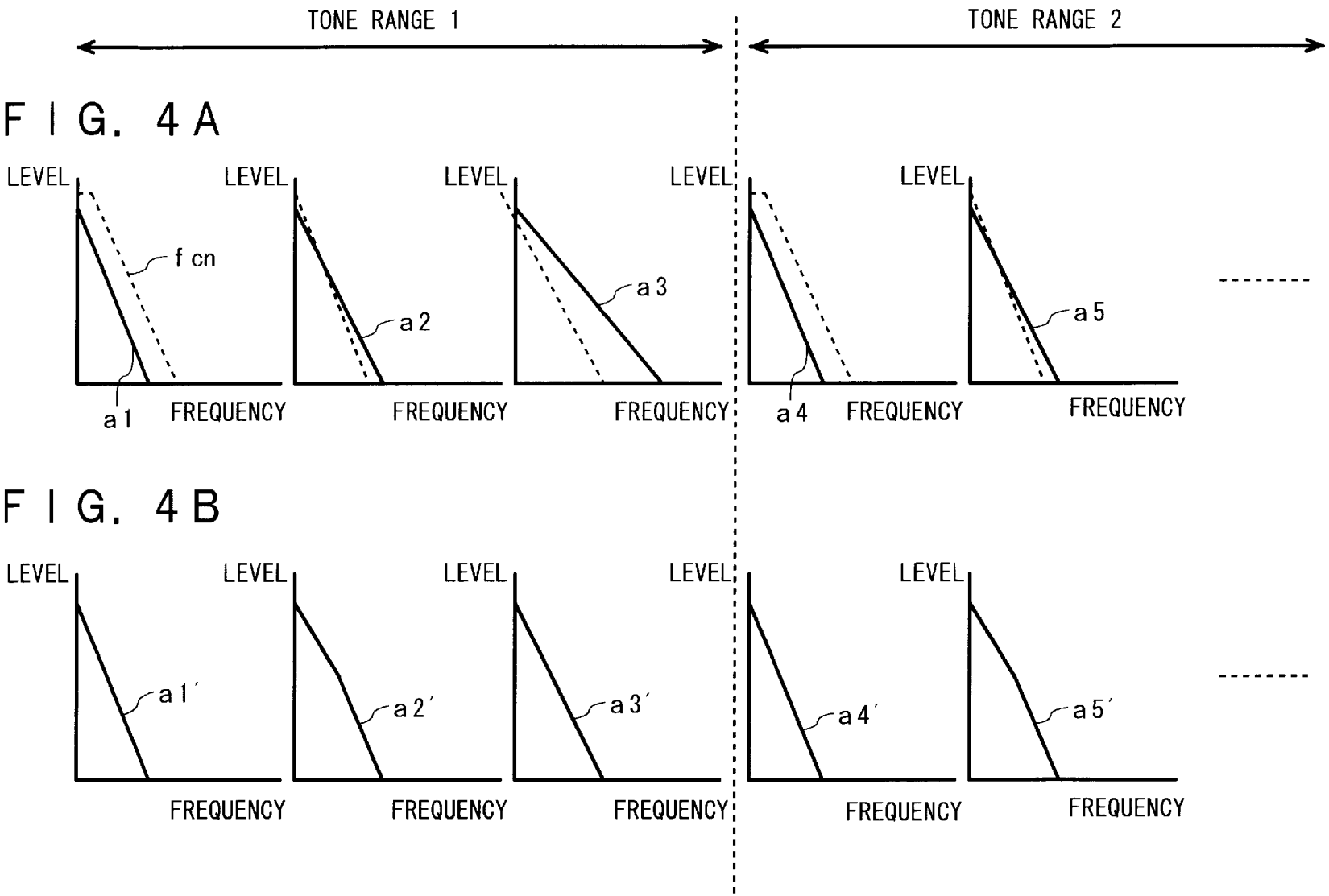
FIGS. 4A and 4B are diagrams for explaining the advantages obtained by the present invention.
Figure 5A:
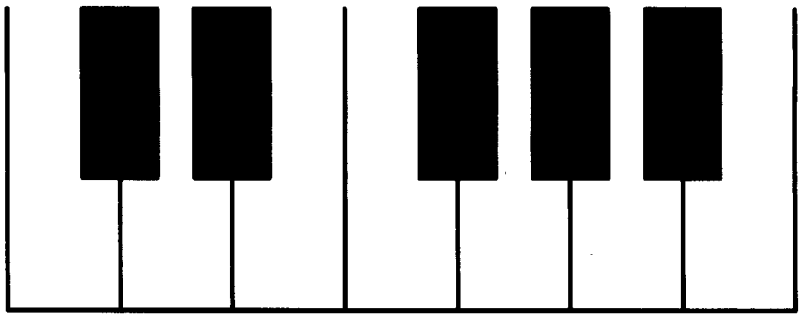
FIGS. 5A and 5B are diagrams for explaining conventional cutoff control.
Figure 5B:
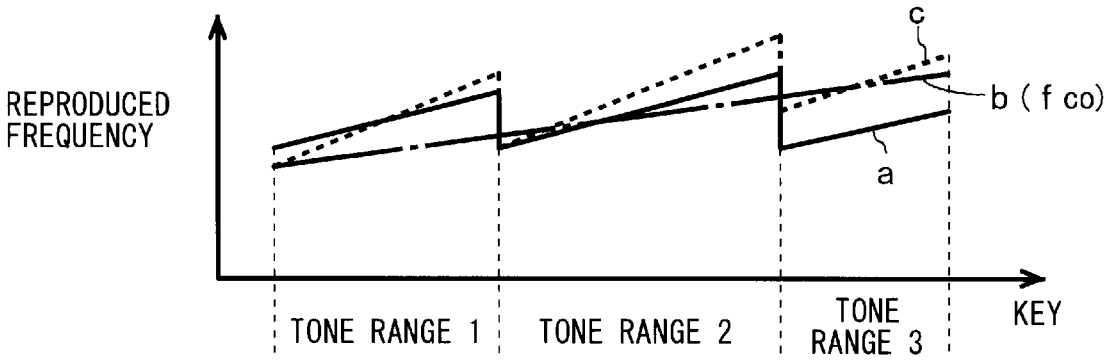

FIGS. 4A and 4B are graphs showing the frequency properties for tone waveforms obtained by the present invention. In FIG. 4A are shown tone signal waveforms a1 to a5 (solid lines) output by the waveform memory 62, and cutoff frequencies fcn (broken lines) applied for the tone signal waveforms a1 to a5. In FIG. 4B are shown waveforms a1' to a5' output by the digital filter 63 as the result of processing performed using the tone signal waveforms a1 to a5. Although the tone signal waveform a3 is are not naturally shifted to the tone signal waveform a4 at a point where the samples are switched, a transition from the waveform a3' to a4' obtained by applying the present invention is apparently natural.

According to the present invention, since reproduced frequencies of tone signals reproduced from the waveform memory means can be continued at points where tone ranges are changed, a change in timbres can be removed at the point where the samples are switched, and a natural continuity can be obtained. As a result, the unnatural connection of musical tones at the points where samples are switched can be removed.

What is claimed is:

1. A tone waveform reproduction apparatus, which is employed for an electronic musical instrument using a plurality of unique sample waveforms respectively representing different tone ranges, said tone waveform reproduction apparatus comprising:

waveform storage means for storing a plurality of unique basic tone waveform data sets respectively representing different tone ranges;

cutoff control means for generating a filter control signal for compensating for a discontinuity, at a point where said tone ranges are switched, of a reproduced frequency of a tone signal that is reproduced from said tone waveform storage means; and filter means, controlled by said cutoff control means, for controlling a frequency of said tone signal reproduced from said tone waveform storage means.

2. A tone waveform reproduction apparatus according to claim 1 wherein said cutoff control means generates and outputs a filter control signal, which corresponds to a cutoff frequency $f_{cn}$ that is determined by using a following equation:

$$f_{cn}=f_{co}\times C_n\times P_o/P_p$$

wherein $f_{co}$ denotes a cutoff frequency acquired by adding an envelope output to an original cutoff frequency; $C_n$ denotes a parameter for adjusting a performance of said cutoff controller; $P_o$ denotes a pitch when basic tone waveform data consonant with a tone range are stored; and $P_p$ denotes a pitch corresponding to a pitch of a key that is depressed.

3. A tone waveform reproduction apparatus for use with an electronic musical instrument using a plurality of unique sample waveforms, each of the plurality of sample waveforms respectively representing a different tone range, said tone waveform reproduction apparatus comprising:

electronic memory for storing a plurality of unique basic tone waveform data sets, each of the plurality of basic tone waveform data sets respectively representing a different tone range;

a cutoff controller for generating a filter control signal for compensating for a discontinuity, at a point where said tone ranges are switched, of a reproduced frequency of a tone signal that is reproduced from said tone waveform storage means; and a filter, controlled by said cutoff controller, for controlling a frequency of said tone signal reproduced from said tone waveform storage means.

4. A tone waveform reproduction apparatus according to claim 1 wherein said cutoff controller control means generates and outputs a filter control signal, which corresponds to a cutoff frequency $f_{cn}$ that is determined by using a following equation:

$$f_{cn}=f_{co}\times C_n\times P_o/P_p$$

wherein $f_{co}$ denotes a cutoff frequency acquired by adding an envelope output to an original cutoff frequency; $C_n$ denotes a parameter for adjusting a performance of said cutoff controller; $P_o$ denotes a pitch when basic tone waveform data consonant with a tone range are stored; and $P_p$ denotes a pitch corresponding to a pitch of a key that is depressed.

5. A method of controlling a frequency of a tone signal reproduced using an electronic musical instrument, the method comprising the steps of:

storing a plurality of unique basic tone waveform data sets, each of the plurality of basic tone waveform data sets respectively representing a different tone range; and generating a filter control signal for compensating for a discontinuity, at a point where said tone ranges are switched, of a reproduced frequency of a tone signal.

6. The method according to claim 5 wherein the generating step comprises generating and outputting a filter control signal, which corresponds to a cutoff frequency $f_{cn}$ that is determined by using a following equation:

$$f_{cn}=f_{co}\times C_n\times P_o/P_p$$

wherein $f_{co}$ denotes a cutoff frequency acquired by adding an envelope output to an original cutoff frequency; $C_n$ denotes a parameter for adjusting a performance of the electronic musical instrument; $P_o$ denotes a pitch when basic tone waveform data consonant with a tone range are stored; and $P_p$ denotes a pitch corresponding to a pitch of a key that is depressed.

* * * * *